US005504948A

United States Patent [19]

Chandler

[11] Patent Number: 5,504,948

[45] Date of Patent: Apr. 9, 1996

[54] COMBINATION TOILET SEAT AND BIDET ATTACHMENT

[75] Inventor: Charles A. Chandler, Centreville, Va.

[73] Assignee: Cory Allen Chandler

[21] Appl. No.: 253,136

[22] Filed: Jul. 11, 1994

[51] Int. Cl.[6] ..... A47K 3/20

[52] U.S. Cl. ..... 4/420.4; 4/447

[58] Field of Search ..... 4/420.4, 447, 448, 4/420.1, 420.5

[56] References Cited

U.S. PATENT DOCUMENTS

| | | | |
|---|---|---|---|
| 2,839,764 | 6/1958 | Gardner | 4/300.3 X |
| 3,879,769 | 4/1975 | Slawinski et al. | 4/447 |
| 4,069,519 | 1/1978 | Alexander | 4/447 |
| 4,094,018 | 7/1978 | Bemthin | 4/447 X |
| 4,553,274 | 11/1985 | Yui | 4/447 X |
| 4,638,514 | 1/1987 | Landsberger | 4/447 X |
| 4,688,275 | 8/1987 | Kuo | 4/420.4 X |
| 4,707,870 | 11/1987 | Glassco et al. | 4/661 |
| 4,850,060 | 7/1989 | Kou | 4/447 X |
| 4,953,238 | 9/1990 | Shifferly | 4/420.4 X |
| 5,279,001 | 1/1994 | Vento | 4/447 |

FOREIGN PATENT DOCUMENTS

| | | | |
|---|---|---|---|
| 0466006 | 10/1951 | Italy | 4/447 |
| 0418997 | 2/1967 | Switzerland | 4/420.4 |

*Primary Examiner*—Robert M. Fetsuga
*Attorney, Agent, or Firm*—Lawrence R. Franklin

[57] ABSTRACT

A bidet attachment is built into a toilet seat, which toilet seat includes a chamber opening to the sides of the seat. The bidet attachment includes a spray nozzle connected to a water supply via lines and valves. The nozzle rotates from a storage position within the chamber of the seat to a use position over the toilet bowl. The supply lines and valves are housed within the seat with the threaded water inlet connectors and flow control knobs extending exteriorly of the toilet seat.

8 Claims, 2 Drawing Sheets

COMBINATION TOILET SEAT AND BIDET ATTACHMENT

BACKGROUND OF THE INVENTION

1. Field of The Invention

This invention relates to a combination toilet seat and bidet attachment in which an apparatus which functions as a bidet is built into a toilet seat.

2. Description of Related Art

Many households desire the benefits of owning and using a bidet for personal, medical, or hygienic reasons. Often existing bathrooms do not have the necessary room in which to install a separate facility. Or, where space is available, the capital necessary to remodel is considered excessive. It is desirable to be able to add the function of a bidet inexpensively without significantly altering the existing structures.

This problem has received the attention of inventors. The following is a representative sample of related prior art as known to the inventor:

Baus, U.S. Pat. No. 4,327,451, shows a bidet attachment in which the bidet nozzle is housed in a cavity, open. downwardly, in the bottom of a toilet seat. The nozzle rotates from a horizontal position within the cavity to a vertical position extending into the toilet bowl. In the latter position, the spray head directs water upwardly toward the seated person.

Landsberger, U.S. Pat. No. 4,638,514, discloses a separate seat which is placed upon the rim of the toilet bowl. A spray nozzle is housed in an open cavity in the bottom of the seat, where it swings horizontally from a retracted position within the cavity to a position wherein the spray head is centrally located within the toilet bowl.

Kuo, U.S. Pat. No. 4,688,275, shows a pair of spray nozzles permanently fixed to a toilet seat, a back one which extends downwardly into the bowl and a forward one extending into the seat's opening. Both direct cleansing fluids centrally and upwardly toward the seated person.

Shifferly, U.S. Pat. No. 4,953,238, attaches a bidet nozzle to the underside of a toilet seat. The nozzle rotates in a substantially horizontal plane from a location between the bottom of the toilet seat and the top of the toilet bowl rim to a position wherein the spray head is centrally located within the toilet bowl.

D'Auria, Swiss Patent No. 418,997, issued Feb. 28, 1967, clips a removable bidet nozzle to the rim of the toilet bowl beneath the toilet seat.

In each of the above-noted combinations of a toilet seat and bidet attachment, the bidet attachment is exposed, especially when the toilet seat has been raised. See FIG. 11 in Shifferly, for instance. It is a fact of life that when a man uses a commode with the toilet seat raised, a certain amount of splatter of a corrosive and unsanitary liquid results, a splatter which must be constantly cleaned from all surfaces on which it lands. The bidet attachments of the prior art are particularly susceptible to this splatter due to their exposure. Because of their size and intricate mechanisms, they are also difficult to keep clean.

OBJECTS AND SUMMARY OF THE INVENTION

The present invention overcomes the difficulties described above by providing a combination toilet seat and bidet attachment wherein the bidet nozzle, when not in use, is stored in a chamber in the toilet seat. The chamber opens to the outside via side openings. The top and bottom walls of the seat form a barrier between the toilet bowl and the chamber housing the bidet attachment, protecting the attachment from splatter. Thus, the combination is more easily kept clean than is the case in the prior art just described.

It is an object of the invention to provide a combination toilet seat and bidet attachment which can be installed in a conventional bathroom simply by replacing the existing toilet seat, providing the advantages of owning a bidet while avoiding the expense and inconvenience of installing a separate bidet by remodeling the bathroom or of replacing the commode with one having a built-in bidet feature.

It is a further object of the invention to provide a more sanitary and easily cleaned combination toilet seat and bidet attachment than was heretofore available.

The foregoing and other objects, aspects, uses, and advantages of the present invention will be more fully appreciated as the same becomes better understood from the following detailed description of a preferred embodiment of the present invention when viewed in conjunction with the accompanying drawings.

DETAILED DESCRIPTION OF THE PREFERRED EMBODIMENT

Figure 1:
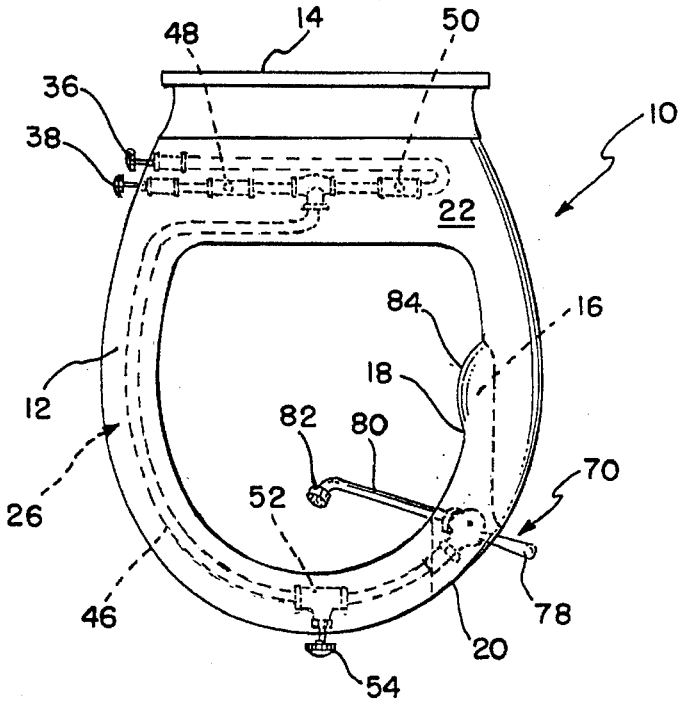
FIG. 1 is a top view of the combination toilet seat and bidet attachment.
Figure 2:
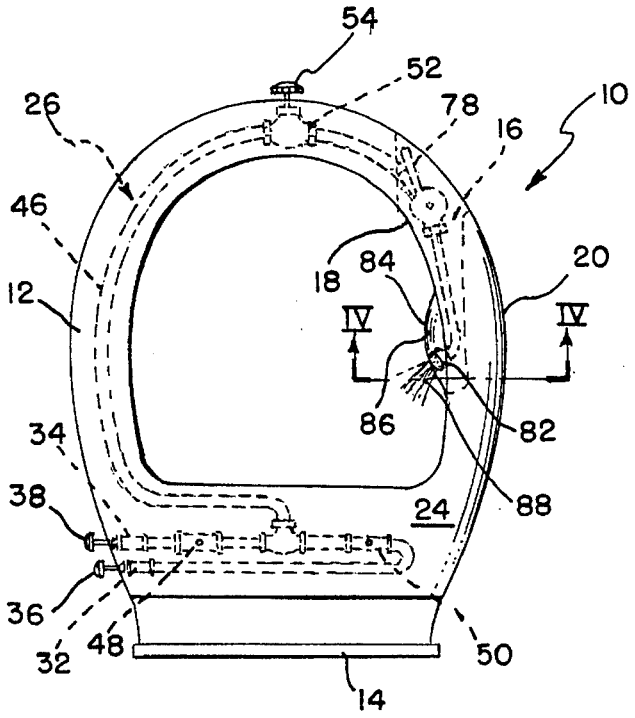
FIG. 2 is a bottom view of the combination toilet seat and bidet attachment.

Referring to FIGS. 1 and 2, the combination toilet seat and bidet attachment 10 is shown. The toilet bowl, toilet seat lid, and mounting brackets normally used with a toilet seat are not shown, as they may be of any suitable design. FIG. 1 depicts a top view, as if the seat is in a lowered position, and FIG. 2 depicts a bottom view, as if the seat is in a raised position.

The seat portion 12 of the combination toilet seat and bidet attachment 10 is shown as generally oval with the conventional central opening. Mounting means 14 for attaching seat 12 to a lid and toilet bowl is shown only diagrammatically. Seat 12 includes a chamber 16 open on both sides 18 and 20. Chamber 16 is shown as being located centrally of the right side of seat 12. It may be located at any convenient part of the seat, e.g., centrally on the left side or forwardly on the right or left side.

Bidet attachment 26 is shown in FIG. 5 in an exploded view. Hot and cold water inlets 28 and 30 comprise threaded connectors for receiving conventional, replaceable hoses connecting inlets 28 and 30 to a suitable water supply (not shown). Valves 32 and 34, responsive to manually actuated knobs 36 and 38, control the hotcold mix of the water, so that the water temperature considered most appropriate can be selected by the user. This manner of temperature control is preferred but is only illustrative, for any water mixing valve structure can be used instead. The temperature controls are shown mounted on seat 12 in FIGS. 1 and 2, but could be mounted at a separate location, so long as the temperature controls are readily accessible to one sitting on seat 12. The disclosed arrangement is preferred, inasmuch as the working invention can be manufactured and sold as a unit.

Inlet lines 40 and 42 connect valves 32 and 34, respectively, to a T-fitting 44, all of which convey the water into supply line 46. Valves 48 and 50, shown diagrammatically, are interposed between inlets 28 and 30 and T-fitting 44, and are spring-biased closed, when no one is seated on seat 12. Valves 48 and 50 separate the hot and cold water lines from intermixing, which allows valves 32 and 34 to set the desired temperature and then be left open. Without valves 48 and 50, the hot and cold water lines would be short-circuited, resulting in all the water in the lines connected thereto to eventually become hot. The valve stems of valves 48 and 50 extend beneath seat 12 into resting contact with the rim of the toilet bowl. The weight of a user depresses the stems, thereby opening the valves. Valves 48 and 50 may be eliminated, in which case inlet lines 40 and 42 would be connected directly to T-fitting 44, although this is not preferred, as it would require the user to shut off valves 32 and 34 after each use and to readjust the temperature of the water before each use.

Supply line 46 is connected to valve 52, manually operated by means of knob 54. Valve 52 not only provides direct control over water flow from bidet attachment 26, but also controls the water pressure issuing therefrom. Knob 54 is preferably located on seat 12 centrally in the forwardmost portion of seat 12, horizontally extending from the front of seat 12 (FIGS. 1 and 2). In such a location, a handicapped person can easily slide onto seat 12 without encountering any obstacles. However, knob 54 could also extend vertically above seat 12 as shown in FIG. 3, or whereever it would be easily accessible.

Line 56 joins valve 52 with fitting 58 and the inlet end 60 of elbow 62 which are rotatable relative to each other. Packing gland 64 and 0-ring 66 prevent leakage from the joint. The outlet end 68 of elbow 62 is rotatably joined with spray nozzle 70 through packing gland 72, O-ring 74, and nozzle inlet 76. Nozzle 70 further includes handle 78, arm 80, and spray head 82. Spray head 82 may be replaceable, so that different spray configurations may be chosen.

All but nozzle 70 comprises a supply means for supplying fluids to said spray nozzle 70. Inlets 28 and 30 comprise connecting means adapted to be connected to an outside source of fluids, typically water, for receiving said fluids. As such, they extend exteriorly to toilet seat 12. Lines 40, 42, 46, and 52 constitute conveying means for conveying said fluids from said connecting means to said nozzle. Valves 32, 34, 48, 50, and 52 comprise valve means for controlling the flow of said fluids through said supply means. The valves include knobs, e.g., knobs 36 and 38, as control means for opening and closing said valve means. Knob 54 additionally functions to manually control the amount of flow of said fluids through said spray nozzle. The lines (the conveying means) and the vanes (the valve means) are housed within the toilet seat, whereas the inlet connectors (the connecting means) and the knobs (the control means) extend exteriorly of said toilet seat.

Figure 3:
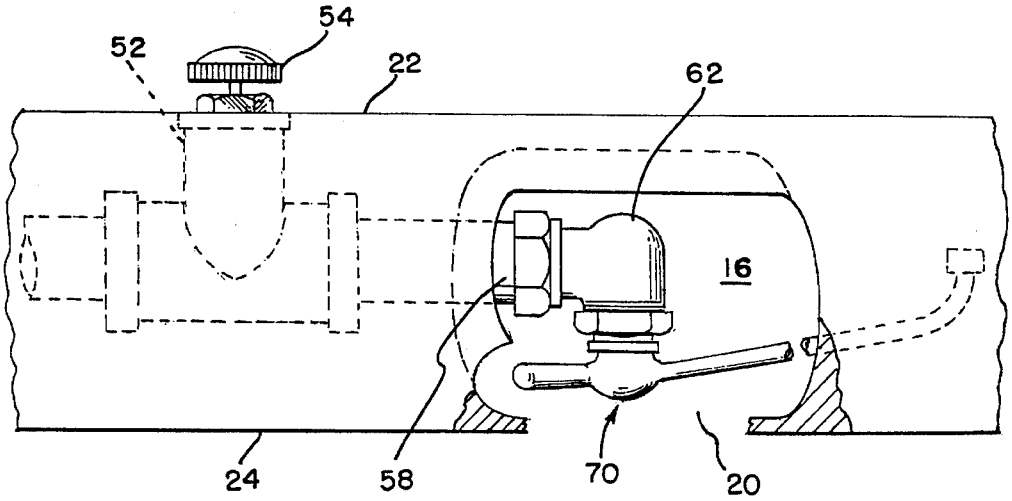
FIG. 3 is a side view of a modified version of the toilet seat looking through a side opening of the chamber to show details of the bidet nozzle.

FIG. 3 is a side view of a portion of seat 12 looking into chamber 16 through opening 20, showing the relative positions of fitting 58, elbow 62, and nozzle 70. The mutually orthogonal rotations permitted at each end of elbow 62 provide directional control of the spray issuing from spray head 82. Nozzle 70 is rotatable about elbow 62 to permit movement of spray head 82 between the exposed position of FIG. 1 and the storage position of FIG. 2. Spray head 82 can also be tilted, due to elbow 62 being rotatable about fitting 58, to direct the spray from spray head 82 onto selected areas of the user's body. The amount of tilting is limited only by the confines of chamber 16.

Figure 4:
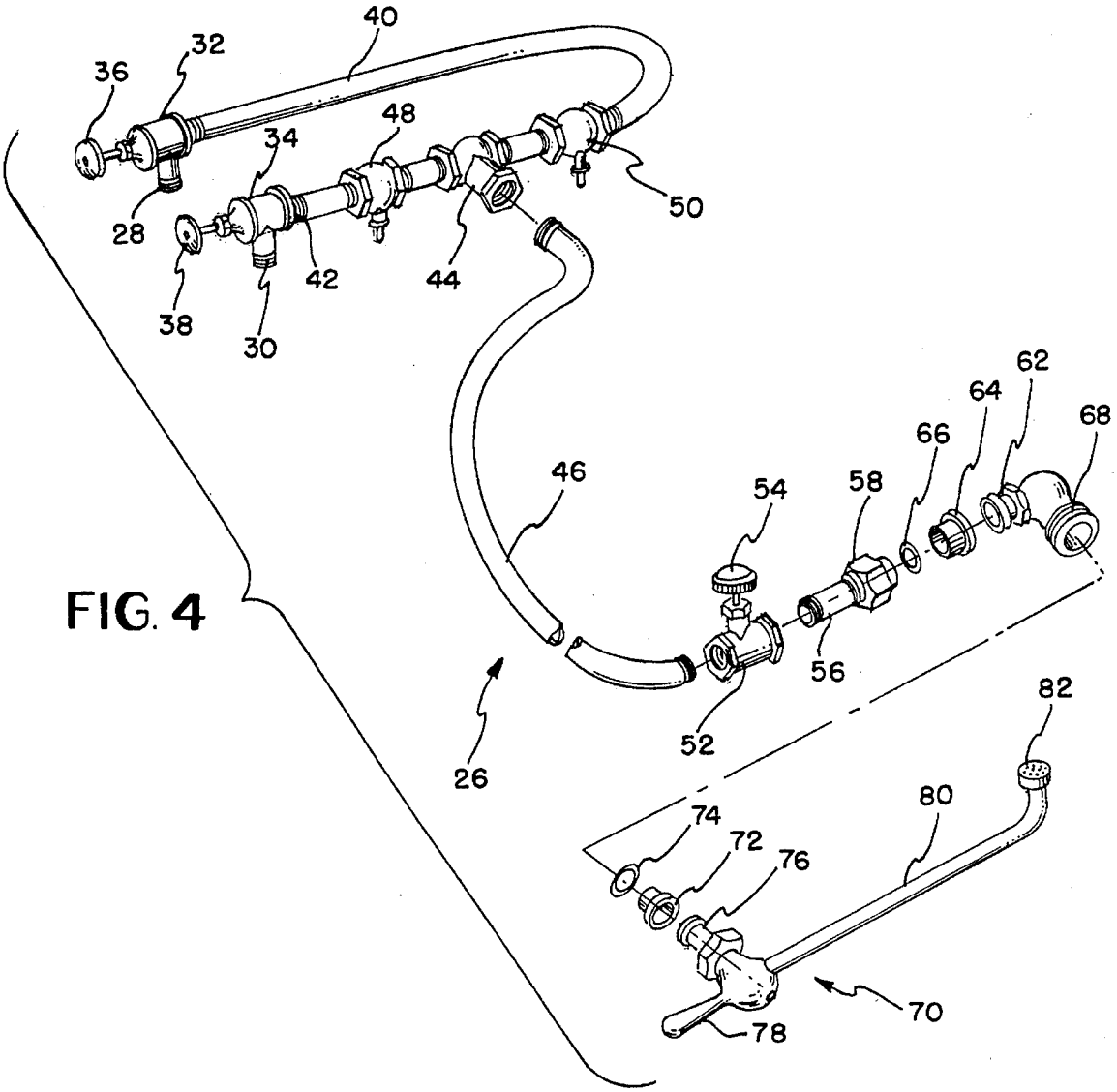
FIG. 4 is an exploded view of the bidet attachment.

A water cap is provided to direct the spray from spray head 82 into the toilet bowl, when nozzle 70 is in the storage position. The water cap comprises a bulge 84 extending from the upper surface over opening 18 of chamber 16 facing the central opening defined by seat 12 (FIGS. 1, 2, and 4). The lower surface 86 of bulge 84 directs water spraying from spray head 82 downwardly into the toilet bowl (not shown); see FIG. 4.

In use, nozzle 70 is normally maintained retracted into the storage position shown in FIGS. 2 and 4. One desiring to use the bidet attachment would sit on seat 12, opening valves 48 and 50 thereby. Valve 52 would be opened, permitting water to flow from the retracted nozzle 70 into the toilet bowl, until the water between T-fitting 44 and nozzle 70, probably colder than the desired temperature, has exited the system. The user need merely reach a hand under bulge 84 to test the temperature of spray 88 flowing downwardly into the toilet bowl. If readjustment of water temperature is needed, it can be effected at that time. When the temperature of the water is acceptable, valve 52 is closed, nozzle 70 is rotated to its operative position (FIG. 1), and valve 52 would again be opened to select the desired water pressure.

The spray from spray head 82 would be directed as desired by means of handle 78 and could be terminated by closing valve 52. Upon the user rising from seat 12, valves 48 and 50 would close automatically, again isolating the hot and cold lines. Nozzle 70 would again be retracted into the storage position of FIG. 2.

It can be seen from the above that an invention has been disclosed which fulfills all the objects of the invention. It is to be understood, however, that the disclosure is by way of illustration only and that the scope of the invention is to be limited solely by the following claims.

I claim:

1. A combination toilet seat and bidet attachment, comprising:

a toilet seat having a top, a bottom, and sides connecting said top and said bottom, said toilet seat enclosing a central opening; said toilet seat including a chamber located within a portion of said toilet seat and extending transverse the width of said portion of said toilet seat, said chamber opening through the sides of said toilet seat; and a bidet attachment comprising:

a spray nozzle, said spray nozzle including a spray head and a handle substantially at opposite ends of said spray nozzle, said spray nozzle being rotatably mounted intermediate said opposite ends on said toilet seat within said chamber, and rotatable between an operative position in which said spray nozzle extends into said central opening and a storage position in which said spray nozzle is located within said chamber, and supply means for supplying fluids to said spray nozzle, wherein said supply means comprises connecting means adapted to be connected to an outside source of fluids for receiving said fluids, conveying means for conveying said fluids from said connecting means to said nozzle; and valve means for controlling the flow of said fluids through said supply means, said valve means including control means for opening and closing said valve means; wherein said conveying means and said valve means are housed within said toilet seat and said connecting means and said control means extend exteriorly of said toilet seat.

2. A combination toilet seat and bidet attachment as in claim 1, wherein said fluid is water, said connecting means are adapted to be connected to an outside source of hot and cold water, and said valve means includes mixing means for mixing said hot and cold water together.

3. A combination toilet seat and bidet attachment as in claim 2, wherein said valve means further includes at least one manually controlled valve for controlling the amount of flow of said water through said spray nozzle.

4. A combination toilet seat and bidet attachment as in claim 3, wherein said control means includes a knob extending horizontally from the front of said toilet seat.

5. A combination toilet seat and bidet attachment as in claim 3, wherein said valve means further includes at least one valve, spring-biased to be closed, connected to said toilet seat and responsive to the weight of a person sitting on said toilet seat to be opened.

6. A combination toilet seat and bidet attachment as in claim 1, wherein said chamber is located in the right side of said seat portion substantially midway between the front and back thereof.

7. A combination toilet seat and bidet attachment as in claim 1, wherein said chamber is located in the left side of said seat portion substantially midway between the front and back thereof.

8. A combination toilet seat and bidet attachment as in claim 1, wherein said spray nozzle is rotatably mounted on said toilet seat by a first fitting rotatably mounting one end of an elbow about a first axis, and a second fitting rotatably mounted to the other end of said elbow about a second axis orthogonal to said first axis, said first fitting being connected to said conveying means and said second fitting being connected to said spray nozzle.

* * * * *